US006955355B2

(12) United States Patent
Denoual

(10) Patent No.: US 6,955,355 B2
(45) **Date of Patent: *Oct. 18, 2005**

(54) BOARD GAME WITH NESTING PIECES

(76) Inventor: Thierry Denoual, 530 Divisadero St., PMB 171, San Francisco, CA (US) 94117

( * ) Notice: Subject to any disclaimer, the term of this patent is extended or adjusted under 35 U.S.C. 154(b) by 0 days.

This patent is subject to a terminal disclaimer.

(21) Appl. No.: 10/393,796

(22) Filed: Mar. 19, 2003

(65) Prior Publication Data

US 2004/0160007 A1 Aug. 19, 2004

Related U.S. Application Data

(60) Provisional application No. 60/447,606, filed on Feb. 14, 2003.

(51) Int. Cl.[7] ..... A63F 3/00

(52) U.S. Cl. ..... 273/290; 273/271

(58) Field of Search ..... 273/288, 290, 273/271, 287; D21/386, 349, 388, 389

(56) References Cited

U.S. PATENT DOCUMENTS 2,896,950 A * 7/1959 Rosti et al. ..... 273/258
3,561,774 A * 2/1971 Brinser ..... 273/241
6,394,455 B1 5/2002 Denoual

* cited by examiner

*Primary Examiner*—Vishu K. Mendiratta
(74) *Attorney, Agent, or Firm*—Johnson & Stainbrook, LLP; Craig M. Stainbrook; Larry D. Johnson

(57) ABSTRACT

A board game is disclosed, said game including a board having at least nine squares arranged in three rows of three squares each. In a first preferred embodiment, each player receives six pieces arranged in two stacks of differentially sized and nested pieces, three pieces to a stack. The object of play is to occupy squares on the board forming a continuous straight line of three pieces of the same color.

11 Claims, 7 Drawing Sheets

BOARD GAME WITH NESTING PIECES

CROSS REFERENCE TO RELATED APPLICATIONS

The present application claims the benefit of the filing date of U.S. Provisional Patent Application, Ser. No. 60/447,606, filed Feb. 14, 2003.

STATEMENT REGARDING FEDERALLY SPONSORED RESEARCH OR DEVELOPMENT

Not applicable.

REFERENCE TO A MICROFICHE APPENDIX

Not applicable.

1. Technical Field

The present invention relates generally to board games, more particularly to a checkerboard-style game board and to stacked nesting pieces for play thereon.

2. Background Information and Discussion of Related Art

Board games are many and varied. Numerous examples exist wherein pieces are played on boards having regular rows and columns of playing squares. Games wherein the object is to line up a specified number of one's pieces in adjacent formation are also known. Many such games have a predictable quality of play. For example, in many, once a player plays a piece of one color on a square, that square is required to be occupied by the same piece throughout the remainder of the game. Differing rules of capture also are taught in the art, many of which may be difficult to remember—at least until a player's facility with the game is developed.

BRIEF SUMMARY OF THE INVENTION

The present invention is a board game comprising a rectilinear playing board having either nine or sixteen squares arranged in three or four rows, respectively, of three or four squares each. The number of squares can be increased depending on the desired complexity, though rectilinear grids of nine and sixteen squares are found to be preferable for widespread appeal having to do with the modest level of complexity and the time required to complete a game. In operation, when using the nine-square grid, each player receives six pieces arranged in two stacks of nested pieces, three pieces to a stack; when using the sixteen-square grid, each player receives twelve pieces arranged in three stack of nested pieces, four pieces to a stack. The object of play is to occupy squares on the board forming a continuous straight line of three or four pieces of the same color.

It is therefore an object of the present invention to provide a new and improved board game with nesting pieces which has all, or nearly all, of the advantages of the prior art, while simultaneously overcoming many of the disadvantages of play and construction normally associated therewith.

It is another object of the present invention to provide a new and improved board game with nesting pieces which may be easily and efficiently manufactured and marketed.

A further object or feature of the present invention is a new and improved board game with nesting pieces which is of a durable and reliable construction.

An even further object of the present invention is to provide a novel board game with nesting pieces which is of high quality but susceptible of a low cost of manufacture with regard to both materials and labor, and which accordingly is then susceptible of low prices of sale to the public, thereby making the board game with nesting pieces economically available to consumers.

Another object or feature is a new and improved board game with nesting pieces that is easy to use, attractive in appearance and suitable for mass production.

An object of this invention is to disclose a small, simple game board comprised of only three to four rows of three to four squares per row.

Another object is to disclose stacking game pieces, namely, pieces of varying sizes, preferably three or four sizes (which sizes hereinafter will be referred to as extra-large, large, medium and small). One small size piece fits under and into a medium size piece. One medium size piece fits under and into a large size piece. Finally, one large size piece fits under and into an extra-large size piece. In this manner, an extra-large piece may have a large, a medium and/or a small piece nested within it.

Accordingly, a feature of this invention is a board game apparatus including a playing board; said playing board forming a rectilinear grid of at least three rows of squares, at least three said squares per row; and a plurality of playing pieces divisible into a first set and a second set of equal number, said first set being visually distinguishable from said second set, said first and second sets each comprising at least a plurality of small pieces, a plurality of medium pieces, a plurality of large pieces, and optionally (in the case of a sixteen-square rectilinear grid) a plurality of extra-large pieces, wherein said small pieces nest within said medium pieces, and said medium pieces nest within said large pieces, and said large pieces nest within said extra-large pieces.

A preferred feature is that said first set has three first-set small pieces, three first-set medium pieces, three first-set large pieces, and three first-set extra-large pieces, and said second set has three second-set small pieces, three second-set medium pieces, three second-set large pieces, and three second-set extra-large pieces.

Still another preferred feature is said first set has a first exterior color and said second set has a second exterior color, wherein said first exterior color is visually distinguishable from said second exterior color.

Preferably, a feature is that said pieces are hollow cylinders.

Still another feature is a method of playing a board game, comprising the steps of providing a playing board forming a rectilinear grid of at least three rows of squares, at least three said squares per row; providing a plurality of playing pieces divisible into a first set and a second set of equal number, said first set being visually distinguishable from said second set, said first and second sets each comprising a plurality of small pieces, a plurality of medium pieces, a plurality of large pieces, and optionally (in the case of sixteen square rectilinear grid) a plurality of extra-large pieces, wherein said small pieces nest within said medium pieces, and said medium pieces nest within said large pieces, and said large pieces nest within said extra-large pieces; and placing said pieces on said squares of said playing board one piece at a time, first one piece from said first set, then one piece from said second set, and alternating thereby until a continuous straight line of a predetermined number of pieces of one of said sets is formed on said playing board, wherein said small pieces may be placed on said squares only on empty squares, said medium pieces may be placed on said squares either on empty squares or on top of said small pieces, said large pieces may be placed on said squares either on empty squares or on top of said medium pieces or said small pieces, and said extra-large pieces may be placed on said squares either on empty squares or on top of said large pieces, said medium pieces or said small pieces.

Other novel features which are characteristic of the invention, as to organization and method of operation, together with further objects and advantages thereof will be better understood from the following description considered in connection with the accompanying drawing, in which preferred embodiments of the invention are illustrated by way of example. It is to be expressly understood, however, that the drawing is for illustration and description only and is not intended as a definition of the limits of the invention. The various features of novelty which characterize the invention are pointed out with particularity in the claims annexed to and forming part of this disclosure. The invention resides not in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the Abstract is to enable the U.S. Patent and Trade-mark Office and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of this application, which is measured by the claims, nor is it intended to be limiting as to the scope of the invention in any way.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE SEVERAL VIEWS OF THE DRAWINGS

The invention will be better understood and objects other than those set forth above will become apparent when consideration is given to the following detailed description thereof. Such description makes reference to the annexed drawing wherein.

DRAWING REFERENCE NUMERALS

Figure 1:
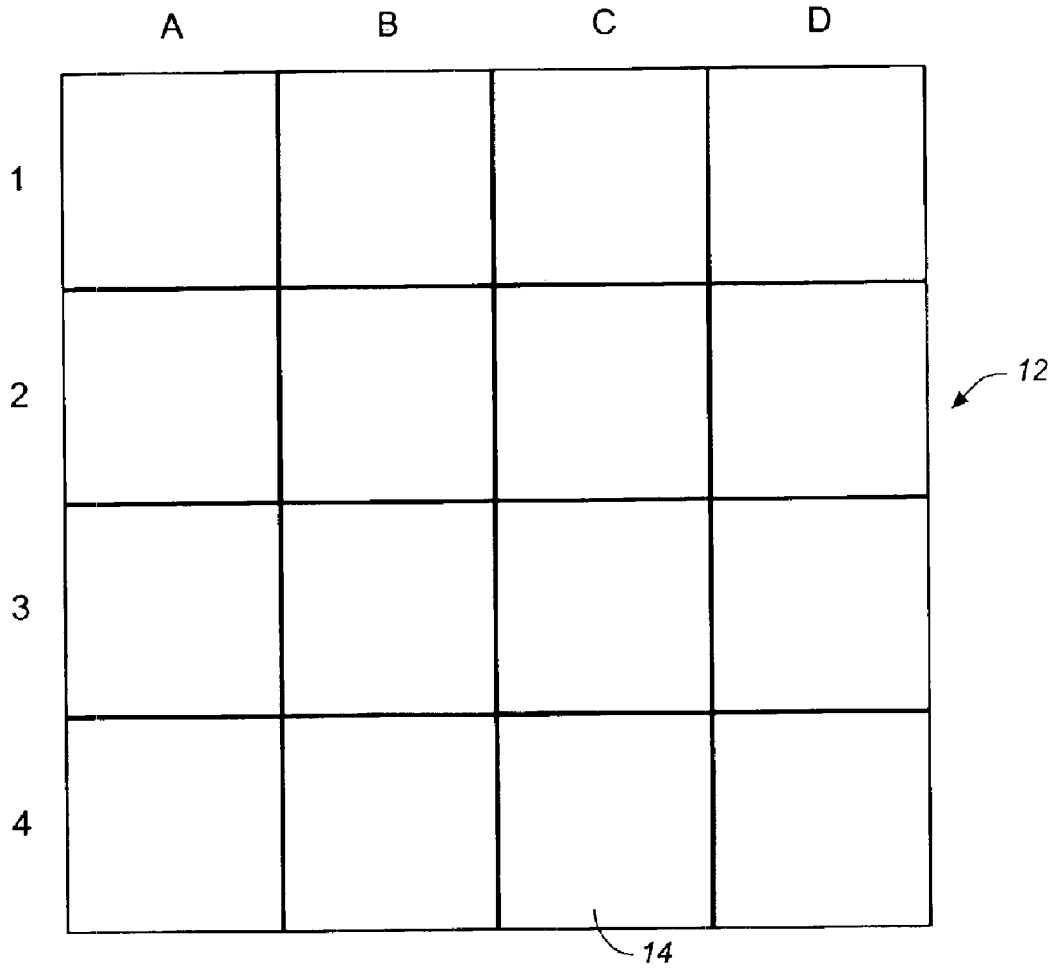
FIG. 1 is a schematic plan view of the board of a first preferred embodiment of the board game with nesting pieces of the present invention.

FIGS. 1–4 (16-square board)
A column
B column
C column
D column
1 row
2 row
3 row
4 row
10 board game with nesting pieces
12 board
14 square
20*a* black extra-large piece
20*b* black extra-large piece
20*c* black extra-large piece
22*a* black large piece
22*b* black large piece
22*c* black large piece
24*a* black medium piece
24*b* black medium piece

24*c* black medium piece
26*a* black small piece
26*b* black small piece
26*c* black small piece
28*a* first black stack
28*b* second black stack
28*c* third black stack
30*a* white extra-large piece
30*b* white extra-large piece
30*c* white extra-large piece
32*a* white large piece
32*b* white large piece
32*c* white large piece
34*a* white medium piece
34*b* white medium piece
34*c* white medium piece
36*a* white small piece
36*b* white small piece
36*c* white small piece
38*a* first white stack
38*b* second white stack
38*c* third white stack
FIGS. 5–8 (9-square board)
A column
B column
C column
1 row
2 row
3 row
110 board game with nesting pieces
112 board
114 square
120*a* black large piece
120*b* black large piece
122*a* black medium piece
122*b* black medium piece
124*a* black small piece (not shown)
124*b* black small piece (not shown)
128*a* first black stack
128*b* second black stack
130*a* white large piece
130*b* white large piece
132*a* white medium piece
132*b* white medium piece (not shown)
134*a* white small piece
134*b* white small piece
138*a* first white stack
138*b* second white stack

DETAILED DESCRIPTION OF THE INVENTION

Referring to FIGS. 1 through 8, wherein like reference numerals refer to like components in the various views, there is illustrated therein a new and improved board game with nesting pieces 10 of this invention.

FIG. 1 illustrates a first preferred embodiment of the game board 12, comprising four horizontal rows, namely, rows 1, 2, 3 and 4. Each row is made up of four squares 14, for a total of sixteen squares 14. Preferably, all squares 14 are of the same color, but they also could be of alternating light and dark color, as in a traditional checkerboard. However, the color and shape of the squares 14 have no effect on the rules of play, nor on the outcome thereof. The four horizontal rows can be viewed as together forming four vertical columns, namely, columns A, B, C and D.

Figure 2A:
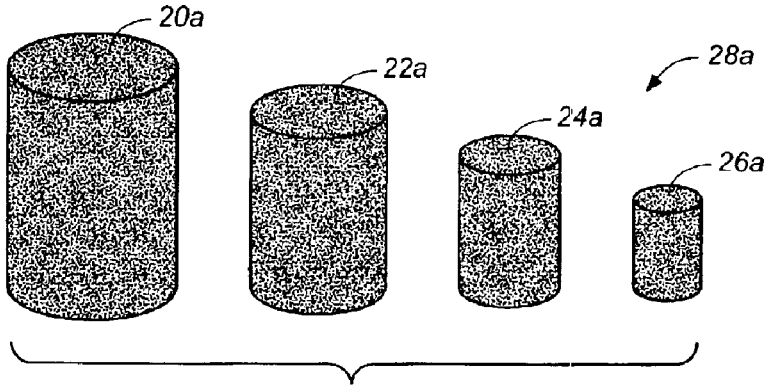
FIG. 2*a* is a perspective view of a first stack of four nesting black pieces.
Figure 2B:
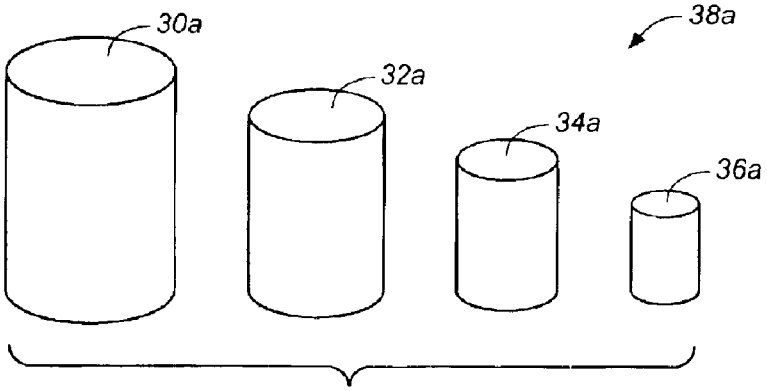
FIG. 2*b* is a perspective view of a first stack of four nesting white pieces, which first stack of white pieces is equal in size and shape to the first stack of black pieces of FIG. 2*a;*
Figure 2C:
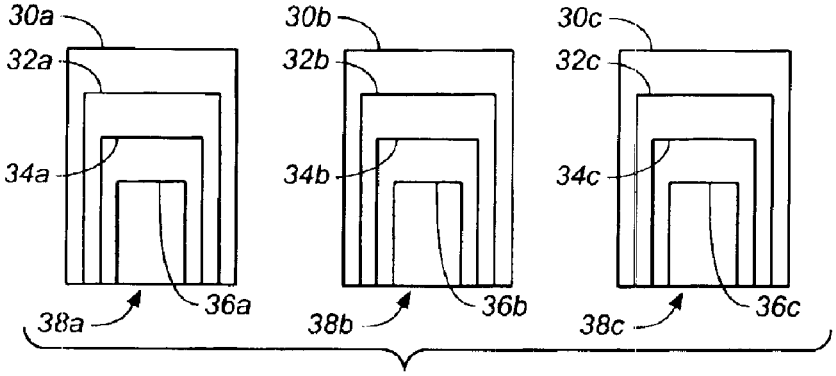
FIG. 2*c* is a schematic frontal cross-sectional view of the first stack of four nesting white pieces of FIG. 2*b*, and of a second and a third stack of four nesting white pieces each, the pieces of the second and third stacks of black pieces (not illustrated) being correspondingly equal in size and shape to the pieces of the second and third stacks of white pieces.
Figure 2D:
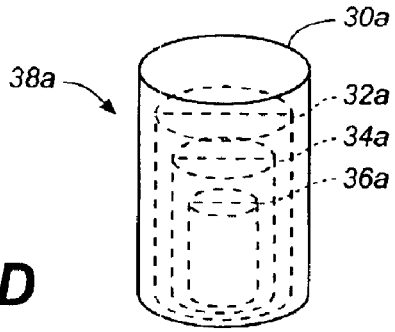
FIG. 2*d* is a perspective view of the first stack of four nesting white pieces of FIG. 2*b*, said stack being shown with the pieces thereof nested within each other in the manner of FIG. 2*c;*

FIGS. 2*a*, 2*b* and 2*c* illustrate the novel playing pieces of the present invention. The nesting pieces come in two visually distinguishable exterior colors, preferably white (or "light") and black (or "dark"). However, any two contrasting colors will do, as well as two contrasting or otherwise visually distinguishable surface designs or the like. Preferably, the pieces are hollow cylinders. However, other equivalent hollow shapes could be used for the pieces, as long as the smaller pieces nest within the internal cavities of the larger.

FIG. 2*a* illustrates a first black stack 28*a* of four black pieces, comprising black extra-large piece 20*a*, black large piece 22*a*, black medium piece 24*a*, and black small piece 26*a*. FIG. 2*b* illustrates a first white stack 38*a* of four white pieces, comprising white extra-large piece 30*a*, white large piece 32*a*, white medium piece 34*a*, and white small piece 36*a*. FIG. 2*c* illustrates the "White" side's full complement of three nested stacks of four white pieces each; namely, first white stack 38*a*, second white stack 38*b*, and third white stack 38*c*. All of the black and white small pieces are of the same height and external diameter, and all fit into (nest within) any black or white medium piece. All medium pieces of either color are of the same height and external diameter, and fit into any large piece of either color. In the same manner, all large pieces are configured to nest or fit within any extra-large piece. In other words, all six stacks used by the two players of the game (dark or light colored) match each other except in color or other external surface decoration—there being preferably only four sizes of pieces total.

OPERATION: It will be perceived that this game readily is adaptable for play in digital form on personal computers, electronic game devices and over the Internet, and such versions of the game comprise alternate embodiments of the present invention. Accordingly, the following discussion of the operation of the invention applies both to game boards and pieces having physical form and to digital depictions thereof on visual displays.

Figure 3:
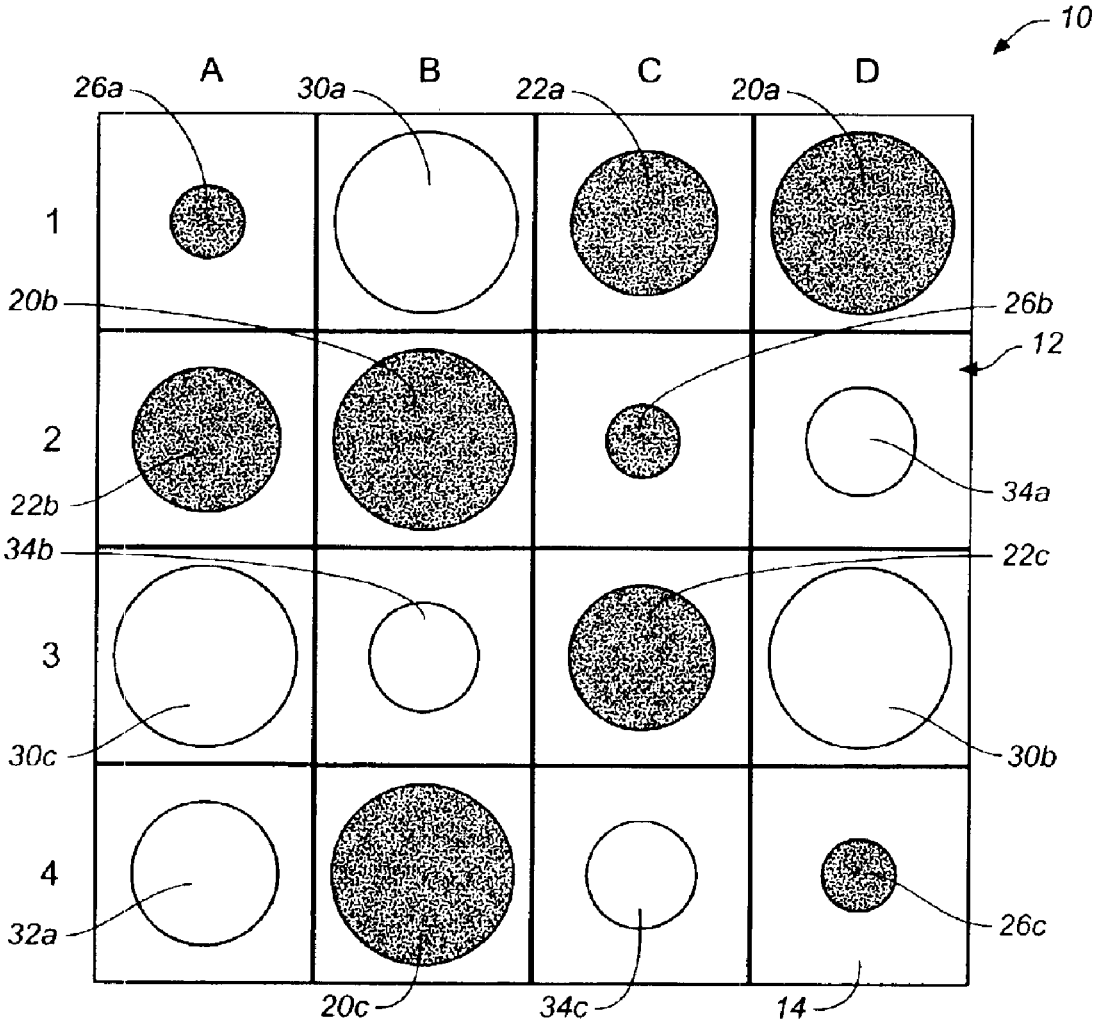
FIG. 3 is a schematic plan view of a first intermediate position of play with the preferred board game with nesting pieces of this invention.
Figure 4:
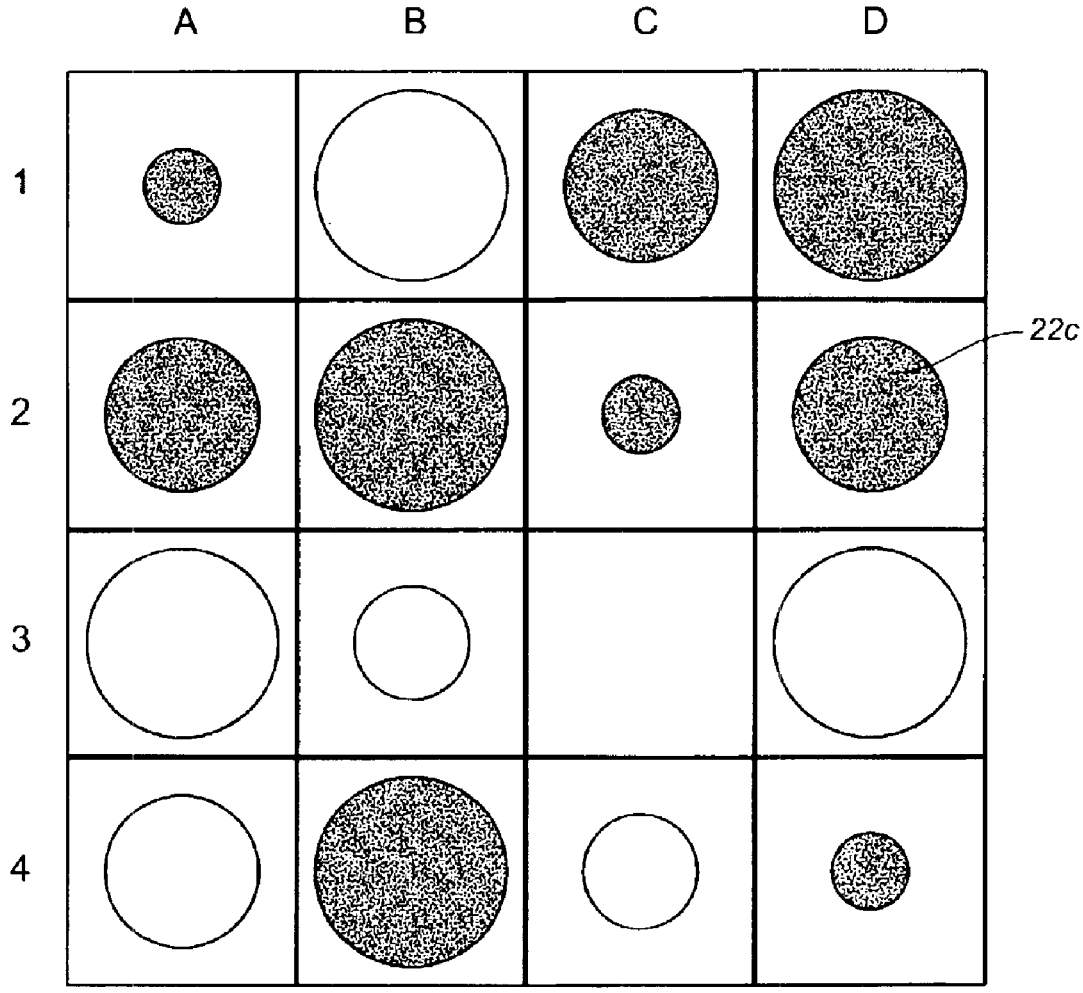
FIG. 4 is a schematic plan view of a final position of play after a single move from the position of FIG. 3.
Figure 5:
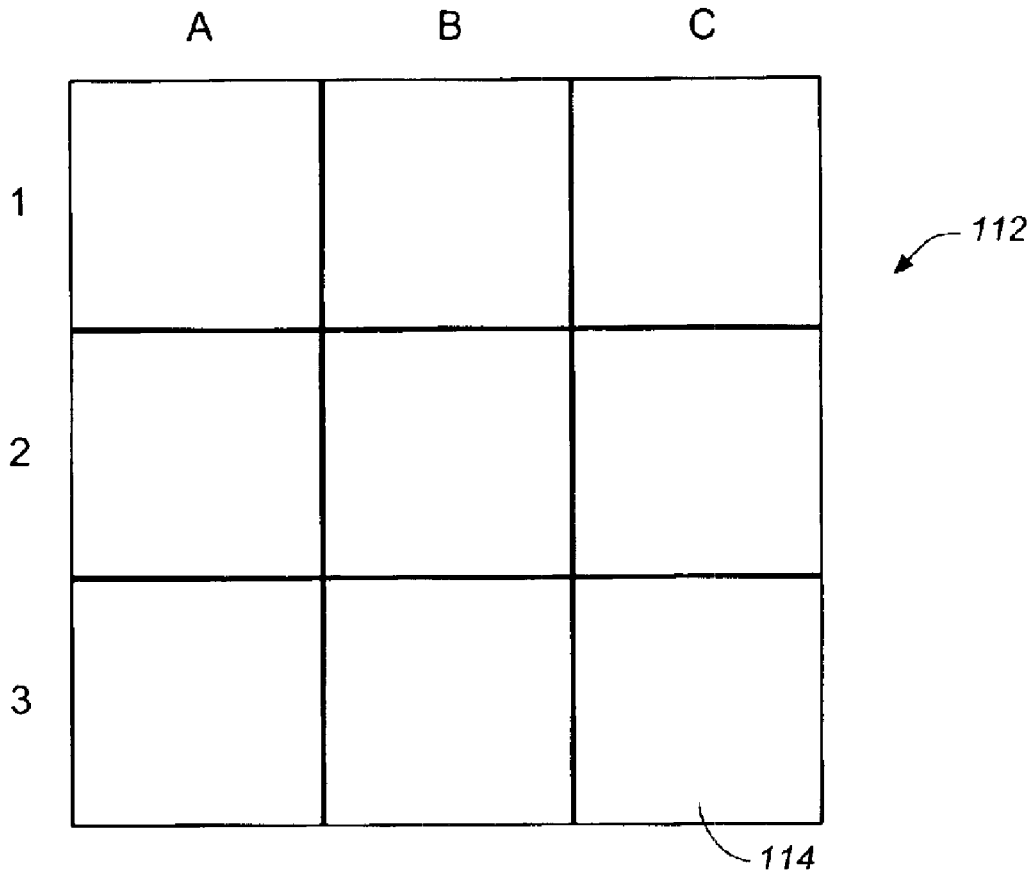
FIG. 5 is a schematic plan view of the board of the second preferred embodiment of the board game with nesting pieces of the present invention.
Figure 6A:
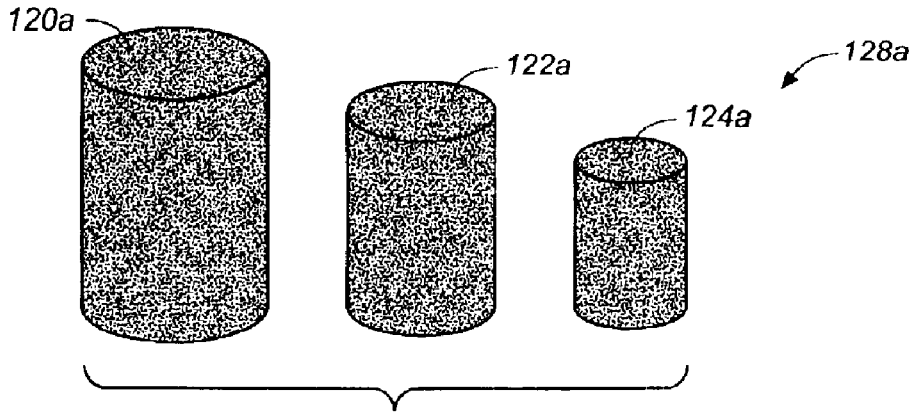
FIG. 6*a* is a perspective view of a first stack of three nesting black pieces.
Figure 6B:
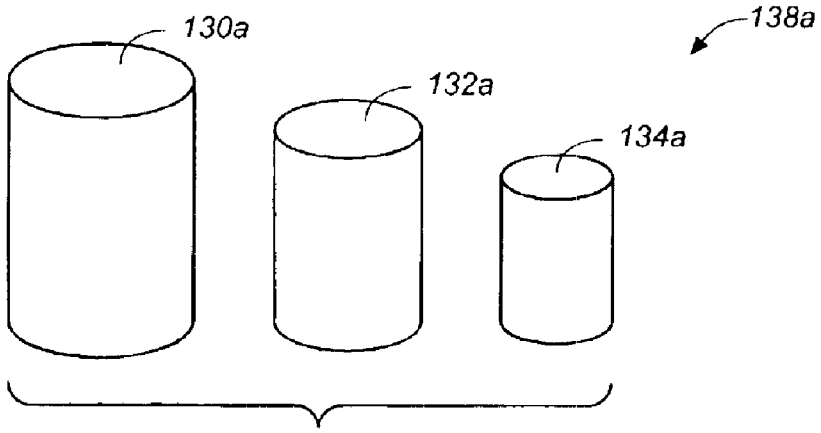
FIG. 6*b* is a perspective view of a first stack of three nesting white pieces, which first stack of white pieces is equal in size and shape to the first stack of black pieces of FIG. 6*a;*
Figure 6C:
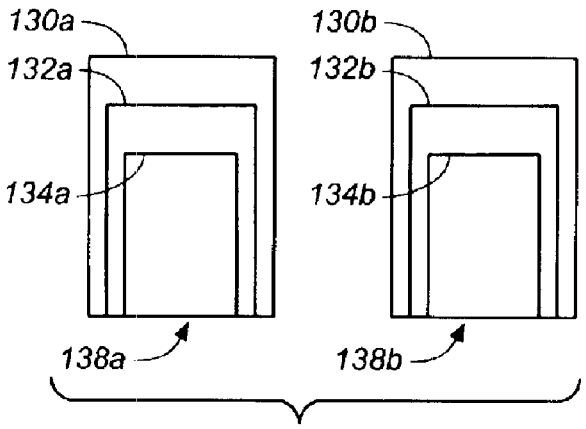
FIG. 6*c* is a schematic frontal cross-sectional view of the first stack of three nesting white pieces of FIG. 6*b*, and of a second stack of three nesting white pieces each, the pieces of the second stack of black pieces (not illustrated) being correspondingly equal in size and shape to the pieces of the second stack of white pieces.
Figure 6D:
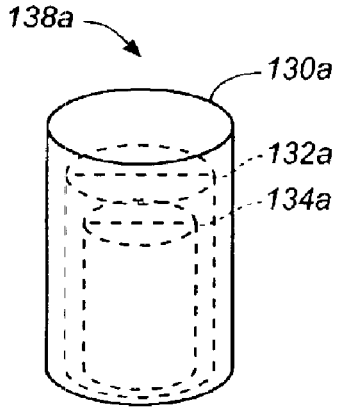
FIG. 6*d* is a perspective view of the first stack of three nesting white pieces of FIG. 6*b*, said stack being shown with the pieces thereof nested within each other in the manner of FIG. 6*c;*
Figure 7:
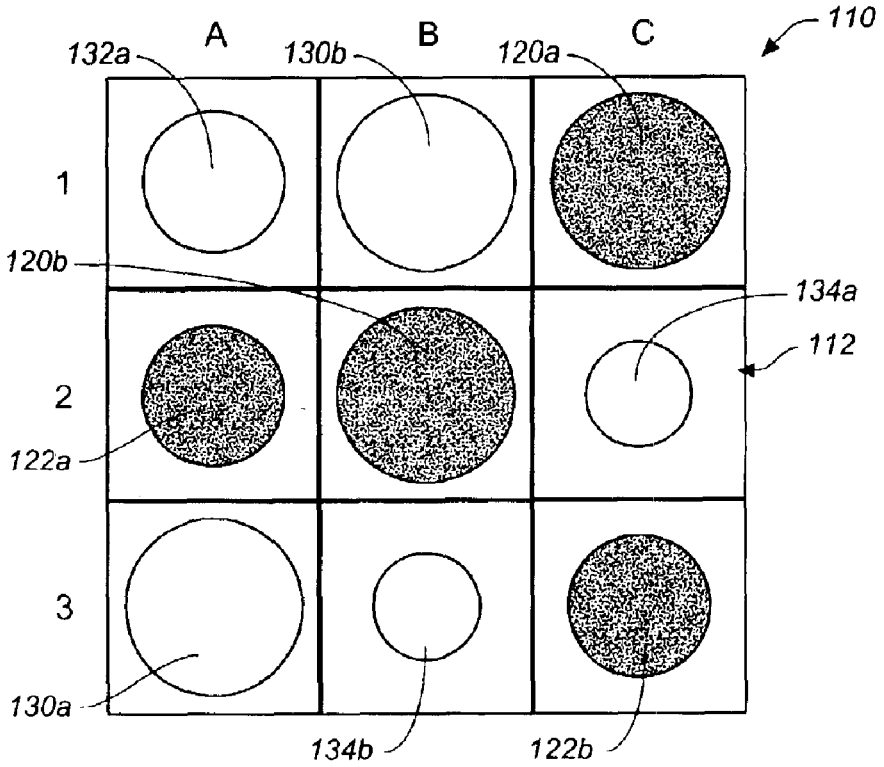
FIG. 7 is a schematic plan view of a first intermediate position of play with the second preferred embodiment of the board game with nesting pieces of this invention.
Figure 8:
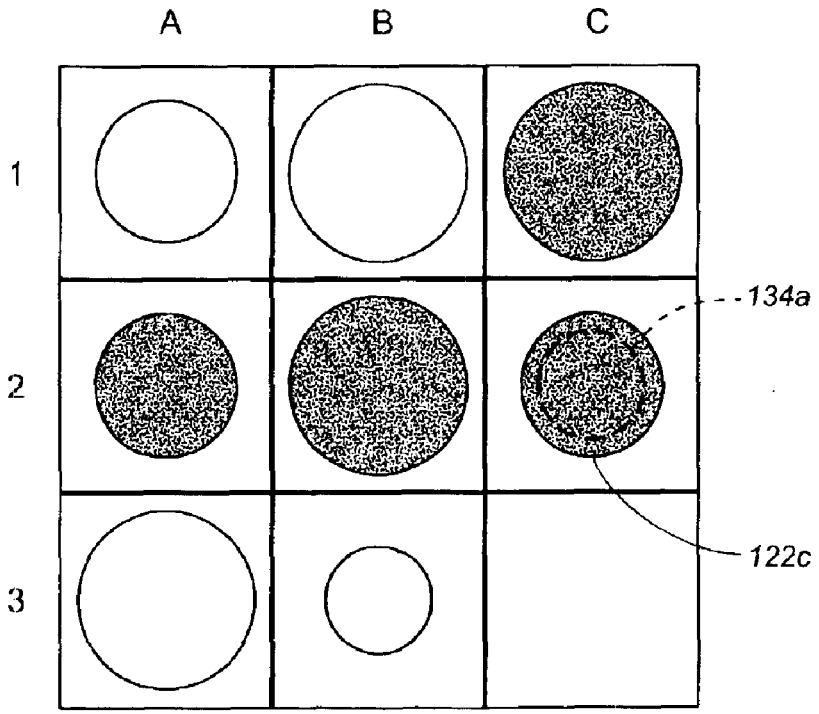
FIG. 8 is a schematic plan view of a final position of play after a single move from the position of FIG. 7.

FIGS. 3 and 4 illustrate the manner of reaching the outcome of the standard play of the game of the present invention. The objective of the game is to form a visible continuous straight line of four pieces of the same color.

Each player gets three identical stacks of four pieces per stack. The pieces need to be stacked before the game starts. The first player, White, uses a first 38*a*, second 38*b* and third 38*c* stacks of white pieces and the second player, Black, uses a first 28*a*, second 28*b* (not illustrated) and third 28*c* (not illustrated) stacks of black pieces. Preferably, the possessor of the white pieces (first player) starts play by taking one of his or her extra-large pieces 30*a*, 30*b* or 30*c* from the top of its stack (a player may not remove a covered piece from inside a stack) and placing it on one of the squares 14 of the board 12. Next, the second player puts one of his or her topmost extra-large black pieces, for example, 20*a*, on an unoccupied square 14.

At this point, for his or her second move, the first player, White, can choose to move the piece played first, to play another extra-large white piece from another stack, or to play a large white piece from the same stack as was used for the first move (for example, large piece 32*a* if white extra-large piece 30*a* was played first). For his or her second move, the second player, Black, similarly could choose to move the extra-large black piece played first, to play another extra-large black piece from the top of another stack, or to play a large black piece from the same stack as was used for the first move, which large black piece now occupies the top of said first-played stack.

But if on the second move White plays a large white piece from the stack used previously, this gives Black a further option. In addition to the above three choices (which are the same as those for the first player's second move), once Black, or any player, encounters on the board pieces of the opponent that are smaller in diameter than one of any of his or her pieces already on the board 12, that player has another option, namely, to cover and entirely conceal from view a smaller piece of the other player. Therefore, if, as previously stated, the first player's second move was to play a large white piece, Black has the additional option on his or her second move of using the extra-large black piece that is already on the board to cover that large white piece-thereby transferring possession of the square on which the large white piece rests to the Black side. It will readily be seen that the inside height and inside diameter of a particular piece automatically determines what pieces it can "capture" in this manner.

The remaining moves proceed in the same fashion. On their turns, players have a choice between taking the exterior piece from the top of one of their stacks to play, or playing one of their own pieces that is already on the board. If a player chooses to play a piece already in play on the board 12, he or she can either place that piece on an empty square 14 or can cover up and entirely conceal any piece of smaller size that is already on the board. If a player chooses to play a new piece from the top of one of his or her stacks, he or she will have to place that piece on an empty square, except if the opponent shows a visible continuous straight line of three pieces of the opponent's own color. Only in that case can a player cover up directly with a "new" (previously un-played) piece one of the opponent's said three visible pieces that are already on the board forming a visible line. If a player has all of his or her pieces already in play, that player must then play with the pieces already located on the board. Preferably, the rules allow players to cover up and entirely conceal one of their own pieces if they so choose.

The first player to form a visible continuous straight line of four of his or her own pieces wins. Players can only move one piece at a time. A preferred rule is that every piece that is touched needs to be played. If a touched piece cannot be legally played, the player loses the game. If a player removes a piece placed over an opponent's piece earlier in the game and this move reveals an opponent's straight line of four pieces, the moving player immediately loses the game if he or she cannot put the piece back over another piece in that same line.

Three game repetitions in a row of identical moves between black pieces and white pieces lead to a draw. Games also can be drawn by mutual consent of the players.

FIG. 3 illustrates one hypothetical board position that might result from play according to the above rules. While all of the squares 14 of the board 12 are occupied when the game is in the position illustrated in FIG. 3, the possibility of covering one's opponent's pieces still remains. In the presently preferred method of play, four pieces of the same color may be aligned either horizontally (along a row), vertically (down a column) or diagonally (from corner to corner) to win. Accordingly, in the preferred version of the rules, FIG. 3 illustrates a win for "Black" (the second player) because four black pieces are aligned diagonally—from the square of row 1 that lies in column A (position A1) to the square at position D4. In the preferred version, FIG. 3 illustrates a final position and the end of a game.

Alternate versions of play may allow for only horizontal lines to count, or only vertical lines, or any combination of one, two or three of the three possibilities, namely, horizontal, vertical and/or diagonal alignments. Assume then, for purposes of illustration, that a rule is chosen wherein only horizontal rows of four same-colored pieces constitute a win. Under such a rule, FIG. 3 would not illustrate a win for black, because the diagonal line of four black pieces from positions A1 to D4 would not be counted.

However, note that in FIG. 3 Black has three pieces aligned horizontally along row 2, while the position D2 is occupied by a white medium piece, namely, piece 34*a*. Assuming it is Black's move, Black can move his or her black large piece 22*c* from square C3 onto square D2. This covers White's white medium piece 34*a* located on square D2 and wins the game for Black by filling row 2 (FIG. 4). Alternatively, to win, Black could have moved the black large piece 22*a* from square C1, or the black extra-large piece 20*a* from square D1, or another previously played black extra-large or large piece onto White's white medium piece 34*a* at square D2.

On the other hand, if it is White's turn to play in the position shown in FIG. 3, White can win under the optional horizontal-line-only rule by moving his or her white extra-large piece 30*a* on square B1 onto square C3, thereby covering Black's black large piece 22*c* presently thereon and forming a row of four white pieces along row 3 (not illustrated).

If desired, the above-described game can be simplified and shortened by providing a smaller board having fewer squares. Thus, in a second preferred embodiment of the present invention, the game board comprises a rectilinear grid of three rows and three columns, each having three squares, thus constituting a nine-square board. The playing pieces for such a board consist of two nested stacks of small, medium, and large pieces. Play on the nine-square board proceeds under the same rules and in the same manner as with the sixteen-square board, with the exception, of course, that play continues until a continuous straight line of a three pieces of one of said sets is formed on the playing board in either a row, column, or diagonal.

Thus, in its most essential aspect, the board game with nested pieces of the present invention comprises a playing board forming a rectilinear grid of at least three rows of squares, at least three squares per row; and a plurality of playing pieces divisible into a first set and a second set of equal number, the first set being visually distinguishable from the second set, the first and second sets each comprising at least a plurality of small pieces, a plurality of medium pieces, and a plurality of large pieces, wherein the small pieces nest within the medium pieces, and the medium pieces nest within the large pieces. The method of playing the game of the present invention comprises the steps of: (a) providing a playing board forming a rectilinear grid of at least three rows of squares, having at least three squares per row; (b) providing a plurality of playing pieces divisible into a first set and a second set of equal number, the first set being visually distinguishable from the second set, and each of the sets comprising a plurality of small pieces, a plurality of medium pieces, and a plurality of large pieces, wherein the small pieces nest within the medium pieces, and the medium pieces nest within the large pieces; and (c) placing the pieces on the squares of the playing board one piece at a time, first one piece from the first set, then one piece from the second set, and thereby alternating until a continuous straight line of a three pieces of one of the sets is formed on the playing board, wherein the small pieces may be placed on the squares only on empty squares, the medium pieces may be placed on the squares either on empty squares or on top of small pieces, and the large pieces may be placed either on empty squares or on top of medium pieces or small pieces occupying squares. When effecting a "covering" move, wherein a piece is placed over an opponent's smaller piece on an occupied square, the covering piece may be selected from the piece or pieces that have not yet been placed on the board, or it may be selected from a piece already occupying a space on the board in an uncovered condition.

As to the remaining manner of usage and operation of the instant invention, the same should be apparent from the above disclosure, and accordingly no further discussion relative to the manner of usage and operation of the instant invention need be provided.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like. For example, an open or transparent window could be provided on the sides or tops of the pieces from which to determine whether a piece was covering a piece of the same or opposite color. Forming shapes other than squares on the board (for example, circles) onto which to place the pieces is a known equivalent in board games.

Therefore, the above description and illustrations should not be construed as limiting the scope of the invention, which is defined by the appended claims.

What is claimed as invention is:

1. A board game with nesting pieces, comprising:

a playing board;

said playing board forming a rectilinear grid of at least three rows of squares, at least three said squares per row; and a plurality of playing pieces divisible into a first set and a second set of equal number, said first set being visually distinguishable from said second set, said first and second sets each comprising at least a plurality of small pieces, a plurality of medium pieces, a plurality of large pieces, wherein said small pieces nest within said medium pieces, and said medium pieces nest within said large pieces and wherein when any one of said medium pieces is placed over any one of said small pieces, said small piece is entirely covered and concealed by said medium piece, and when any one of said large pieces is placed over any one said medium pieces or any of said small pieces, or any combination of a medium piece previously placed over a small piece, said medium piece and/or said small piece, and/or said medium covering said small piece, is entirely covered and concealed.

2. The apparatus of claim 1 wherein there are three said rows, each said row having three said squares, for a total of nine said squares on said playing board formed into a rectilinear pattern having three columns.

3. The apparatus of claim 2 wherein said first set has two first-set small pieces, two first-set medium pieces, and two first-set large pieces, and said second set has two second-set small pieces, two second-set medium pieces, and two second-set large pieces.

4. The apparatus of claim 3 wherein said first set has a first exterior color, and said second set has a second exterior color wherein said first exterior color is visually distinguishable from said second exterior color.

5. The apparatus of claim 4 wherein said first exterior color is light and said second exterior color is dark.

6. The apparatus of claim 3 wherein said pieces are hollow cylinders.

7. A method of playing a board game in which players alternate turns, comprising the steps of:

providing a playing board forming a rectilinear grid of at least three rows of squares, at least three said squares per row;

providing a plurality of playing pieces divisible into a first set for use by a first player and a second set of equal number for use by a second player, said first set being visually distinguishable from said second set, said first and second sets each comprising a plurality of small pieces, a plurality of medium pieces, and a plurality of large pieces, wherein said small pieces nest within said medium pieces, and said medium pieces nest within said large pieces; and placing said pieces on said squares of said playing board one piece at a time, first one piece from said first set, then one piece from said second set, and thereby alternating until a continuous straight line of a predetermined number of pieces of one of said sets is formed on said playing board, wherein on any giving turn a player may place any one of said small pieces in his or her set only on empty squares, or any one of said medium pieces in his or her set either on empty squares or on top of said small pieces to entirely cover and conceal said small piece, or any one of said large pieces in his or her set either on empty squares or on to of said medium pieces or said small pieces or on top of any medium piece already covering a small piece to entirely cover and conceal said medium piece, said small piece, and/or said medium piece covering said small piece.

8. The method of claim 7 wherein:

there are three said rows, each said row having three said squares, for a total of nine said squares on said playing board formed into a rectilinear pattern having three columns; and there are six pieces in said first set and six pieces in said second set.

9. The method of claim 8 wherein said first set has two first-set small pieces, two first-set medium pieces, and two first-set large pieces, said second set has two second-set small pieces, two second-set medium pieces, and two second-set large pieces, and said predetermined number is three.

10. The method of claim 9 further including the step of first arranging said first and said second sets into two stacks of three nested pieces per stack, and wherein said pieces may be placed on said squares directly from said stacks only by removing the largest remaining piece of a stack from the top thereof.

11. The method of claim 10 wherein when a said piece is placed on a said square, it may be taken from one of said stacks or it may be moved from a different square on said playing board onto which said piece had previously been placed.

* * * * *